United States Patent [19]

Malroit

[11] 4,108,484

[45] Aug. 22, 1978

[54] COLLAPSIBLE GRAPPLE

[76] Inventor: Richard R. Malroit, 9142 N. Bennett, Skokie, Ill. 60203

[21] Appl. No.: 756,730

[22] Filed: Jan. 4, 1977

[51] Int. Cl.[2] ..... B66C 1/34

[52] U.S. Cl. ..... 294/66 R; 114/303; 294/82 R

[58] Field of Search ..... 294/66 R, 78 R, 82 R; 43/1, 5, 43.1, 43.16, 43.4, 44.82; 114/294, 301–304

[56] References Cited

U.S. PATENT DOCUMENTS

| | | | |
|---|---|---|---|
| 1,875,182 | 8/1932 | Southwell | 43/44.82 |
| 2,496,503 | 2/1950 | Tamm | 114/303 |
| 3,092,412 | 6/1963 | Drake | 294/82 R X |
| 3,277,857 | 10/1966 | Canatella | 114/303 |

FOREIGN PATENT DOCUMENTS

| | | | |
|---|---|---|---|
| 113,627 | 8/1941 | Australia | 294/66 R |

*Primary Examiner*—Johnny D. Cherry
*Attorney, Agent, or Firm*—Olson, Trexler, Wolters, Bushnell & Fosse, Ltd.

[57] ABSTRACT

A collapsible grapple comprises a pair of selectively assembleable members. The first member includes a pair of elongated shanks or side elements confluent at their upper ends to form a single part and defining between them an elongate slot. The second member similarly comprises a pair of elongated shank or side elements confluent at their upper ends to form a single part and defining between them an elongate slot. The side elements of the second member converge below their upper ends to form a first loop, then part and converge again below the first loop to form a second loop between the first and second convergences. The lower ends of the side elements of both members extend away from the elongated slot and have pointed ends to define a pair of hooks lying in substantially the same plane as the side elements.

6 Claims, 4 Drawing Figures

COLLAPSIBLE GRAPPLE

BACKGROUND OF THE INVENTION

The present invention relates generally to grapples and more particularly to a collapsible grapple which can be easily assembled and disassembled for convenient use and safe transport when not in use.

While the collapsible grapple according to the present invention is suited for a number of uses including as a grapple on the end of a crane boom for industrial use or as a carrier for parts in a plating bath, the following description will be facilitated by addressing the specific problem of providing a collapsible grapple for use as an anchor in marine applications, especially for pleasure craft.

Fishermen using small boats have encountered a number of problems associated with the use of rigid anchors. While an anchor is desirable in many cases to limit the drifting or movement of a small boat during fishing, many rigid anchors heretofore in use have presented severe short-comings. Specifically, rigid anchors are often cumbersome to store and transport when not in use and may present a hazard when resting in the bottom of a boat. The pointed hooks of a rigid anchor present a danger and potential source of injury to the occupants of the boat as well as to the hull of the boat itself. Several collapsible-type anchors have also been proposed and developed to avoid some of these problems, but these have commonly been relatively complicated and expensive.

Collapsible anchors known in the prior art typically include a substantial number of parts such as interlocking mechanisms, stops, sliding positioning plates or members and hinges. These many parts, in addition to being cumbersome to manipulate and adding expense to the anchor, also may prove susceptible to rusting or jamming in use thereby rendering the collapsible feature inoperative. Also, known collapsible anchors often present several rigid, unitary parts which project in different planes thus preventing convenient and simple storage of the disassembled parts in a relatively flat condition.

Accordingly, it is an object of the present invention to provide a new and improved, collapsible grapple which is simple in its construction and inexpensive to manufacture.

It is a further object of the present invention to provide a new and improved, collapsible grapple which comprises relatively few parts and is easy to assemble and disassemble.

It is a further object of the present invention to provide a collapsible grapple which is efficient and reliable in operation and which may be conveniently and safely transported in a relatively flat condition.

SUMMARY OF THE INVENTION

Briefly, the collapsible grapple according to the present invention comprises a first and a second member. The first member comprises a pair of elongated shank or side elements confluent at a top portion thereof to form a single part and define an elongate, generally keyhole-shaped slot between the shank elements. The lower ends of the shank elements extend outwardly of the elongate slot and upwardly at a slight angle and terminate in pointed ends to form an opposing pair of hooks at an angle to and substantially in the plane of the shank members. The second member similarly comprises a pair of elongate shanks confluent at their top portion to form a single part and define an elongate slot therebetween. The two shank elements converge somewhat below their confluent top to form a first opening or aperture to receive a connecting line such as a boat line. The two shank elements curve outwardly and converge again somewhat below the first aperture to form a second opening or aperture to receive the first member. Below the second aperture the shanks are bent apart to define generally an inverted V-shaped slot. The bottom portions of each of the shank elements of the second member, in a similar fashion to the first member, curve or extend outwardly of the V-shaped slot and terminate in pointed ends to define a pair of hooks at an angle to and in substantially the same plane as the shank elements.

The foregoing as well as other objects and advantages of the present invention will become more readily apparent from the following detailed description when considered together with the acompanying drawing wherein the same reference numberals are used throughout the various figures to indicate the same elements and components.

DETAILED DESCRIPTION OF THE ILLUSTRATED EMBODIMENT

Figure 1:
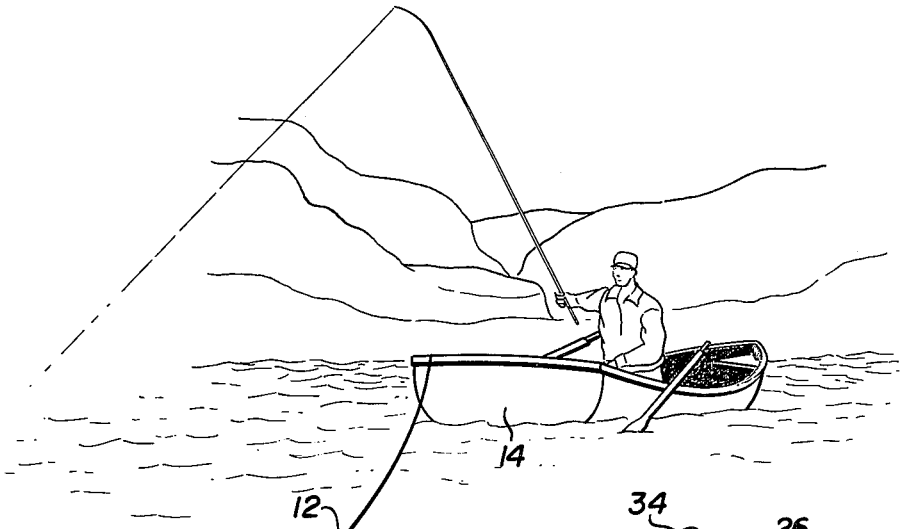
FIG. 1 is a perspective view of a boat employing a collapsible grapple according to the present invention as an anchor, attached thereto by a line and engaging the bottom of a body of water.
Figure 1:
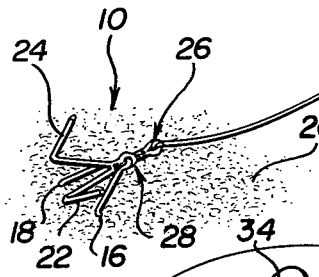

Referring now to FIG. 1, a collapsible grapple 10 constructed in accordance with the preferred embodiment of the invention is shown connected by a line 12 to a small boat 14 to be used as an anchoring device therefor. The collapsible grapple 10 is shown with two hook portions 16 and 18 thereof engaging the bed or bottom 10 of a body of water which may be, as an example, rocky, or it may be gravel or silt. It will be noted, in conjunction with FIG. 1, that the collapsible grapple 10 is so constructed that two or three of the hooks thereof, such as hooks 16 and 18 will engage the bottom 20 whenever the collapsible grapple 10 is thrown into the water and the line 12 is momentarily pulled taut to engage the hooks with the bottom 20. In FIG. 1, hooks 22 and 24 are shown not in engagement with the bottom 20. The construction of the grapple 10 so as to cause this engagement of two or more hooks is described in greater detail hereinafter.

Figure 2:
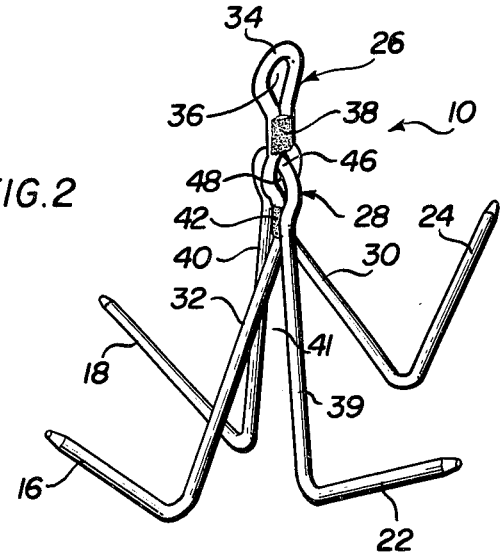
FIG. 2 is an enlarged, perspective view of the collapsible grapple of FIG. 1 in its assembled condition.
Figure 3:
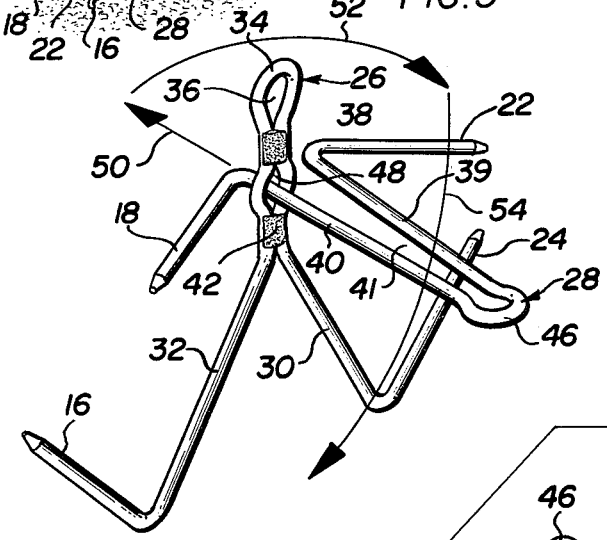
FIG. 3 is a perspective view of the two members of the collapsible grapple of the present invention, illustrating the method of assembly thereof.
Figure 4:
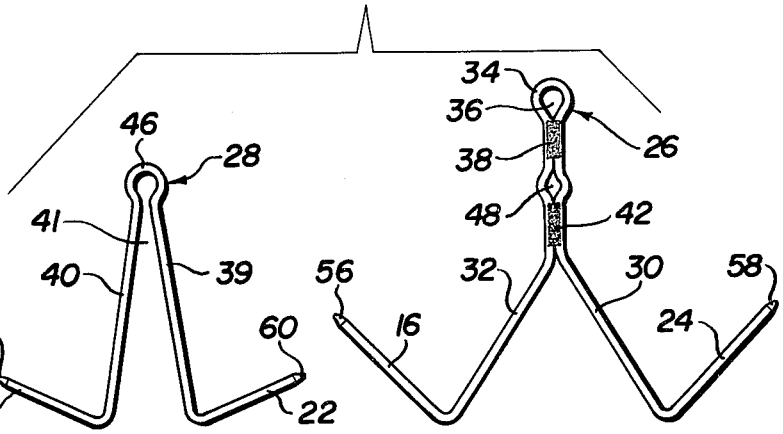
FIG. 4 is a front elevational view of the two members of a collapsible grapple of the present invention, shown in disassembled conditon.

Turning now to FIGS. 2 and 4, a perspective view and a front elevation of the collapsible grapple 10 somewhat enlarged from that of FIG. 1, reveals additional details thereof. The grapple 16 comprises two substantially planar members 26 and 28. The member 26 comprises a pair of shank or side elements 30 and 32 which are joined at the top portion 34 thereof to form a single part. The two shank elements 30 and 32 are curved to provide an opening or aperture 36 which is closed by a weldment 38 disposed below the top portion 34. The opening or eye 36 may be used to attach the grapple to the boat such as by tying the line 12 through opening 36 as illustrated in FIG. 1. It will be noted that the shank or side elements 30 and 32 then bow out somewhat below the weldment 38 and again come together where they are joined by a second weldment 42 as seen best in FIGS. 3 and 4. A second opening or aperture 48 is thus formed between the weldments 38 and 42 through which the second member 26 is inserted, as will be described in detail hereinafter. Below the weldment 42, the shank or side elements 30 and 32 diverge at an acute angle, defining a triangular or inverted V-shaped slot or opening therebetween. The end portions 24 and 16 of the shank elements 30 and 32 extend outwardly and upwardly of the pendant portions of the shank elements terminating in pointed ends 56 and 58 to form a pair of opposing hooks, at an angle to and in the same plane as the shank portions 30 and 32.

A member 28 is similarly formed of two shank or side elements 39 and 40 joined at their top portion 46 to form a continuous integral member which is inserted through the opening or eye 48 of the member 26. Thus, member 28 has its top portion 46 pivotally engaged in slot 48 of member 26 as best seen in FIG. 2. Shank or side elements 39 and 40 define between them a generally elongate substantially keyhole-shaped slot 41. End portions 22 and 18 of the shank elements 39 and 40 extend outwardly and upwardly of the generally pendant portions 39 and 40 terminating in pointed ends 60 and 62 to form a pair of opposing hooks extending outwardly at an angle to and in the same plane as side elements 39 and 40. FIG. 2 illustrates the collapsible grapple 10 in its fully assembled state.

Attention is directed to FIG. 3, wherein the method of assembly of the collapsible grapple 10, in particular, the fitting together of the two members 26 and 28 thereof is illustrated in detail. Member 28 has its end or hook portion 18 inserted through the eye or opening 48 of member 26 and and is then angled slightly so that the shank or side element 40 thereof slides through aperture or opening 48 in the direction indicated by arrow 50. When the top portion 46 of member 28 reaches the opening 48, the member 28 may then be freely rotated within the opening 48 and relative to member 26 in the direction indicated by arrow 52 until the slot 41 is above and in parallel with shank or side element 30 of member 26. Member 28 may then be rotated downwardly in the direction indicated by arrow 54 until it reaches the position illustrated in FIG. 2. Thus, the slot 41 passes over the shank 30 and hook portion 24 of member 26 allowing the shank members 39 and 40 of member 28 to pass on either side thereof.

From the foregoing description, it is apparent that the collapsible grapple may be readily disassembled by reversing the procedure.

From the foregoing descriptions of FIG. 3 and FIG. 2, the features of the collapsible grapple 10 in its fully assembled state which cause two or three of the hooks thereof to engage the bottom 20 as hereinabove described will become readily apparent. The member 28 is free to pivot or rotate about a single axis defined by its top or joining portion 46 within the aperture 48, that is, perpendicular to the plane of member 26. However, the member 28 is effectively held against rotation in other directions or planes by the engagement of side elements 39 and 40 with the weldment 42 at the upper portion thereof and with the side elements 30 and 32 and hooks 16 and 24 of member 26 at a lower portion thereof. Thus, all other directions of rotation of the member 28 to the member 26 are effectively stopped until the member 28 is rotated sufficiently about the plane of member 26 to allow the side elements 39 and 40 to clear either of the hooks 16 or 24 of member 26. In accordance with this assembled relation of the members 26 and 28, the terminal points 56, 58, 60 and 62 of the hook portions 16, 18, 22 and 24 will tend to remain in an alignment which substantially defines the corners of the parallelogram and thus at least two of the hook portions will tend to engage the bottom.

Referring now again to FIG. 4, the two members 26 and 28 are illustrated in side elevation. The various parts thereof have already been described in detail in the reference to FIGS. 2 and 4 hereinabove, however, it will be noted that, in FIG. 4, the members 26 and 28 occupy substantially a single plane. Thus, it is apparent that the disassembled grapple 10 comprising members 26 and 28 may be readily stored and transported in a relatively flat, compact condition, as for example, by placing member 28 immediately on top of member 26.

It will also be noted from the illustration of FIG. 4, that the members 26 and 28 are generally of similar shape and construction. Thus, the manufacture of the grapple 10 comprising members 26 and 28, according to the present invention, is relatively simple and economical. The members 26 and 28 may be formed from the same material such as a metallic rod of suitable thickness and temper. The manufacturing process, then, involves cutting suitable lengths of rod, performing several bending operations, and providing weldments for the member 26. For example, the members 26 and 28 each may be formed from a length of rod bent over upon itself to give the configuration described above.

While a preferred embodiment has been shown and described, various changes in modifications therein may become apparent to those skilled in the art, and will be understood as falling within the spirit and scope of the present invention as defined by the appended claims.

The invention is claimed as follows:

1. A collapsible grapple comprising first and second substantially planar members, said first member comprising a first pair of elongate shanks and a top portion joined to said shanks for defining a slot therebetween, said first pair of shanks further including lower ends extending outwardly of said slot and terminating in pointed ends to form a first opposing pair of hooks at an angle to and substantially in the plane of said first pair of shanks, said second member comprising a second pair of elongate shanks and a top portion joining said second pair of shanks and said second pair of shanks curving inwardly below said top portion to a first confluence to form a first aperture to receive a connecting line, and curving outwardly below said first confluence and back inwardly to a second confluence to form a second aperture to receive the first member, said second pair of shanks being spaced to define a slot below said second aperture and having lower ends extending outwardly of said slot and terminating in pointed ends to define a second opposing pair of hooks disposed at an angle to and in the same plane as said second pair of shanks, said top portion of said first member traversing and pivotally engaging within said second aperture of said second member but confined against any substantial non-pivotal movement with said second pair of hooks generally perpendicular to said first pair of hooks, and with the upper portions of said first pair of shanks adjacent the second confluence positioned for permissive interfering engagement therewith in resisting rotation of the first member about the longitudinal axis of the second member when assembled.

2. A collapsible grapple according to claim 1 wherein said first and second members are selectively disassembleable, said first member being rotatable in the plane of said second member to clear said second pair of hooks and slidably removable, upon said clearance, with respect to said second aperture.

3. A collapsible grapple according to claim 2 wherein said first member and said second member are each substantially co-planar whereby said first member and said second member are storable and transportable in a relatively flat condition when disassembled.

4. A collapsible grapple according to claim 1 wherein said first and second confluences include a first and second weldment respectively, joining said first pair of shanks at said first and second confluences.

5. A collapsible grapple according to claim 4 wherein said first member is rotatable relative to said second member about an axis defined by said top portion of said first member and is limited in rotation in other directions relative to said second member by said second confluence, said second pair of shanks and said second pair of hooks.

6. A collapsible grapple comprising a first member and a second member, said first member comprising a first generally elongate rod bent over upon itself to form a first pair of co-planar shanks defining a generally keyhole-shaped slot therebetween, said first pair of shanks having lower portions extending outwardly of said slot and upwardly and terminating in pointed ends to form a first opposing pair of hooks co-planar with said first pair of shanks and said keyhole-shaped slot, said second member comprising a second elongate rod bent over upon itself to define a second pair of shanks, means forming a first aperture in said second member to receive a connecting line, means defining a second aperture in said second member to receive said first member pivotally with confinement against any substantial non-pivotal movement and with the proximate portions of the first pair of shanks at the narrow portion of the keyhole-shaped slot disposed adjacent the second pair of shanks in the vicinity of the second aperture for permissive interfering engagement therewith in resisting rotation of the first member about the longitudinal axis of the second member when assembled, and each of said second pair of shanks having an end portion extending outwardly of said second aperture and terminating in pointed ends to define a second opposing pair of hooks at an angle to and in the same plane as the second pair of shanks.

* * * * *